United States Patent [19]

Bolli

[11] Patent Number: 4,883,440

[45] Date of Patent: Nov. 28, 1989

[54] ELECTRIFIED TOY BUILDING BLOCK WITH ZIG-ZAG CURRENT CARRYING STRUCTURE

[75] Inventor: Peter Bolli, Steinhausen, Switzerland

[73] Assignee: Interlego A.G., Baar, Switzerland

[21] Appl. No.: 8,640

[22] Filed: Jan. 29, 1987

[30] Foreign Application Priority Data

Feb. 5, 1986 [CH] Switzerland ..... 461/86

[51] Int. Cl.[4] ..... A63H 33/08

[52] U.S. Cl. ..... 446/91; 446/128; 446/484; 439/752

[58] Field of Search ..... 446/91, 105, 108, 125, 446/128, 484, 91, 128, 484; 200/307; 339/210 R, 210 M; 439/752

[56] References Cited

U.S. PATENT DOCUMENTS

| | | | |
|---|---|---|---|
| 3,237,341 | 3/1966 | Janning | 446/91 |
| 3,400,485 | 9/1968 | Callin et al. | 446/108 |
| 3,447,249 | 6/1969 | Greger | 446/9 |
| 3,484,984 | 12/1969 | Fischer | 446/91 |
| 3,552,055 | 1/1971 | Matsubayashi et al. | 446/128 |
| 3,732,529 | 5/1973 | Weisenburger | 339/210 M |
| 3,854,790 | 12/1974 | Provinsky | 339/210 R |
| 4,423,465 | 12/1983 | Teng-Ching et al. | 200/307 |
| 4,552,541 | 11/1985 | Bolli | 446/484 |
| 4,556,393 | 12/1985 | Bolli | 446/484 |
| 4,743,202 | 5/1988 | Bach | 446/91 X |

FOREIGN PATENT DOCUMENTS

| | | | |
|---|---|---|---|
| 692074 | 6/1940 | Fed. Rep. of Germany | 339/210 R |
| 1098422 | 1/1961 | Fed. Rep. of Germany | 446/128 |
| 2569900 | 3/1986 | France | 200/307 |
| 593084 | 11/1977 | Switzerland | 446/91 |
| 1442602 | 7/1976 | United Kingdom | 446/108 |

*Primary Examiner*—Mickey Yu
*Assistant Examiner*—Charles H. Harris
*Attorney, Agent, or Firm*—Kane, Dalsimer, Sullivan, Kurucz, Levy, Eisele and Richard

[57] ABSTRACT

A building block is provided comprising a support part, two zig-zag shaped conductive tapes connecting a series of coupling pins with conductive surfaces positioned on the support part, and a cover plate. The coupling pins which extend through openings in the cover plate define two separate electrical circuits with the coupling pins arranged in two rows and the pins of one row being displaced by one pin with respect to the pins of the other row. A prong extends from each of the coupling pins to the inner sidewall of the support part. The building block may be connected to another similar building block with the electrical circuits separated in a short-circuit proof fashion.

11 Claims, 2 Drawing Sheets

ELECTRIFIED TOY BUILDING BLOCK WITH ZIG-ZAG CURRENT CARRYING STRUCTURE

BACKGROUND OF THE INVENTION

The present invention relates to building blocks and in particular to toy building blocks for construction sets.

In European patent publication No. 0,116,519 and U.S. Pat. No. 4,556,393 toy building blocks for construction sets are disclosed. Such building blocks have side walls and a wall extending perpendicular thereto which is provided on one side with two rows of coupling pins and on the other side with counter coupling sockets which cooperate with the coupling pins to provide a mechanical coupling or clamping effect between two such blocks. Every other coupling pin of each row is provided with a conductive surface and the alternate pins are electrically insulated. One row of pins is offset with respect to the other row by one coupling pin in the direction of the rows. A contact bar is mounted on the other side of the wall along each longitudinal sidewall and is in electrical contact with the conductive coupling pins of the corresponding row and has a contact face for making electrical contact with a row of conductive coupling pins of an adjacent coupled block. During coupling of two such blocks in the longitudinal direction or vertical thereto, it is possible to obtain a short circuit-proof coupling of two separate electrical circuits. However, if a model is built by electrically coupling such prior art building blocks in more than two planes a problem arises in that the electrical circuits may be shortened. This is particularly so when an electrical loop is formed during the construction of the model.

It is an object of the present invention to provide a building block of the aforementioned type with which an absolute short circuit-proof coupling of two electrically separated conductors may be attained even if a large number of such blocks are coupled to each other and even if electrical loops are formed.

Surprisingly, with the building blocks of the present invention short circuits cannot be caused between the two electrical conductors due to the zig-zag arrangement of the connection between respective conducting coupling pins even if a large number of such blocks are coupled mechanically and electrically in any structure and orientation. As a result, the present building blocks permit even an inexperienced user or a child to form electrical circuits without problem.

An exemplified embodiment of the building blocks of the present invention along with a method of making the same is explained in more detail forthwith in conjunction with the drawings which illustrate the following:

DETAILED DESCRIPTION OF THE PREFERRED EMBODIMENT

Figure 1:
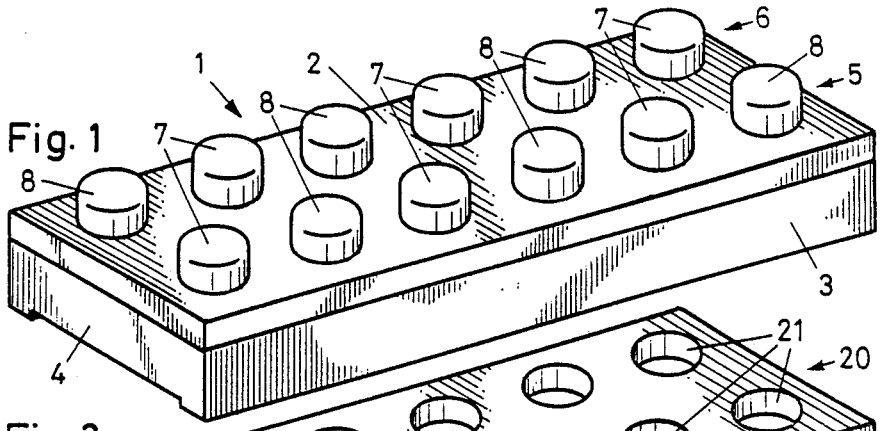
FIG. 1 is a perspective view of a building block in accordance with the present invention.

Referring to FIG. 1 it can be seen that the outer shape and dimensions of the present building block are quite similar to building blocks which have been available for some time under the registered trademark "LEGO". Thus, the building block consists of a generally rectangular plastic body 1 which is open on its underside. The building block has a top wall 2, long sidewalls 3 and short sidewalls 4. The top wall is provided with two parallel rows 5, 6 of cylindrical coupling pins 7, 8 arranged side-by-side which permit mechanical coupling in a conventional manner with sockets within the hollow underside of a similar building block by plugging the one into the other. The building block of FIG. 1 differs from prior art blocks, however, in that each of the coupling pins 7, 8 has a conductive metallic surface encompassing at least the outer face of the coupling pins.

As will be explained in more detail, the coupling pins are connected with each other in two groups in such a manner that all of the coupling pins 7 form a first electrical conductor and all of the coupling pins 8 form a second electrical conductor. The connection of the coupling pins is effected through the use of two zig-zag members inserted within the building block. The coupling pins of each member are displaced with respect to those of the other by the longitudinal distance between two adjacent coupling pins.

The components of the building block of FIG. 1 are set forth individually in sequence in FIGS. 2 to 5 in the order of assembly. Thus, in FIG. 5 the bottom structural part is depicted comprising a generally rectangular support part 9. Support part 9, which is formed of plastic is hollow (although this cannot be seen). The top surface 10 of support part 9 is provided with a plurality of openings, recesses, and protrusions including:

two rows of slotted openings 11 disposed along and adjacent to the longitudinal sidewalls 3. The slots are aligned in the longitudinal direction of the coupling pins 7, 8 of FIG. 1;

round holes 12 positioned between adjacent slots 11 and also including two disposed along the center line of support part 9 close to the short walls 4;

rectangular recesses 13 disposed at an angle of 45° with respect to the slots 11 and generally positioned along the center line of support part 9 between the rows of slots, the alternate recesses being displaced by about 90° with respect to each other. Each of the recesses 13 is provided at its center along its longitudinal edges with a pair of protrusions 14.

The function of the aforementioned openings, recesses and protrusions will become apparent from the following description of the other structural parts of the building block of FIG. 1.

Figure 3:
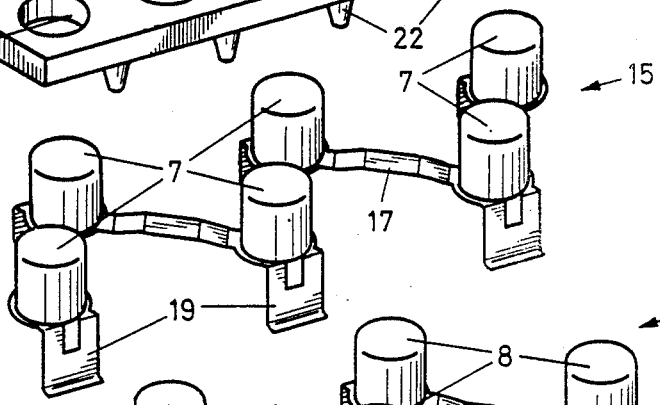
Figure 4:
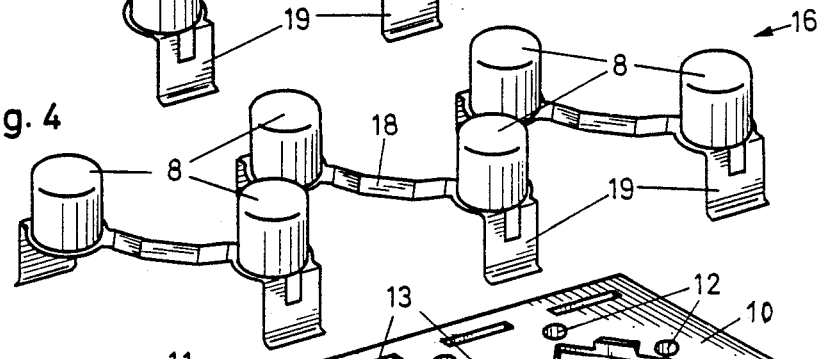
Figure 5:
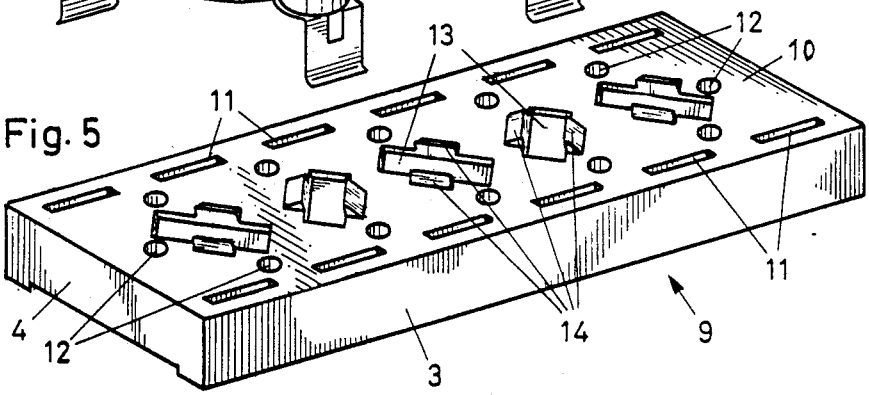

In FIG. 3 and 4 there are depicted tape-like members 15 and 16 containing the coupling pins or cylinders 7 and 8, respectively. The coupling pins 7, 8 comprise hollow cylinders arranged in zig-zag fashion along tapes 15 and 16, respectively. Thus, coupling pins 7 are connected to each other by the tape-like conductor segment 17 (FIG. 3) and coupling pins 8 are connected to each other by the tape-like conductor 18 (FIG. 4). As can be seen, the conductor segments 17 of FIG. 3 are bent downwardly. A downwardly directed prong 19 having an elongated tip is provided at the underside of each of the coupling pins 7, 8. The width of each prong 19 corresponds to the length of the slots 11 of support part 9. The length of each prong 19 is somewhat less than the height of the longitudinal sidewalls 3 of support part 9. It should be apparent that the entire tapes 15, 16 may each be formed of a single piece of metal tape.

Figure 2:
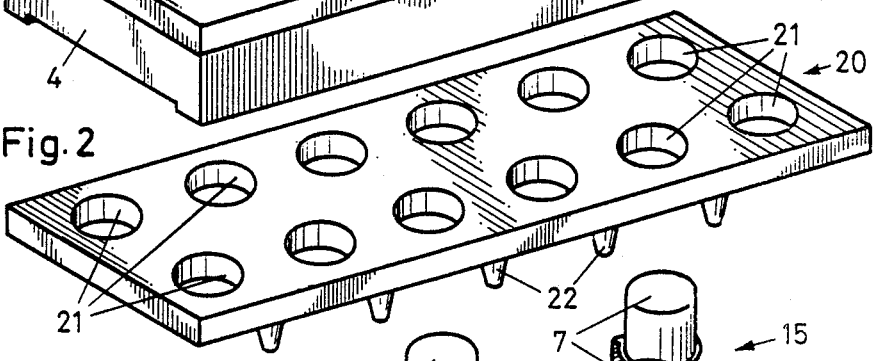
FIGS. 2 to FIG. 5 are perspective views of the individual components of the building block of FIG. 1, set forth in the sequence of assembly.

A fourth structural part is depicted in FIG. 2 and comprises a plate-like, relatively thin cover 20 for the building block. Cover 20 is formed of plastic and comprises a rectangular shape having the same dimensions as support part 9. Cover 20 is provided with holes 21 through which the coupling pins 7, 8 pass. The underside of the cover 20 is provided with elongated pins 22 having a thickness generally corresponding to the diameter of holes 12 of part 9 and aligned with the holes. The end of each of the pins 22 is conical.

Figure 6:
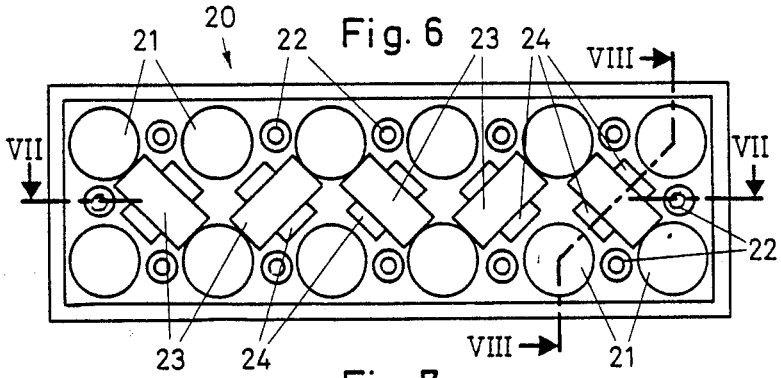
FIG. 6 is a plan view of the underside of the upper cover plate depicted in FIG. 2.
Figure 8:
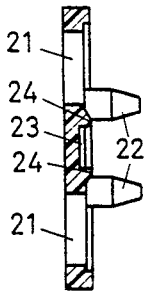
FIG. 8 is a cross sectional view taken along line VII—VII of FIG. 6.
Figure 7:
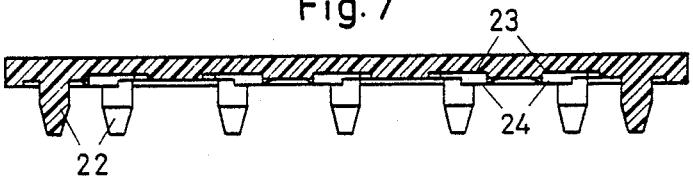
FIG. 7 is a longitudinal sectional view taken long line VII—VII of FIG. 6.

Reference is now made to FIG. 6 which depicts the underside of the cover part 20 and to FIGS. 7 and 8 which are sectional views thereof. Thus, the holes 21 for the coupling pins 7 and 8 can be seen in FIG. 6 and the elongated pins 22 can be seen in FIGS. 6 to 8. FIG. 6 also shows that the cover part 20 is provided with elongated rectangular recesses provided on its underside along the center line of the cover part which are disposed at an angle of 45° between adjacent holes 21 of the same row and on the diagonal with respect to the two longitudinal rows of holes. In addition, it can be seen that the recesses are alternately displaced with respect to each other by 90°. Protrusions 24 are provided in pairs along the longitudinal edges of each of the recesses 23.

Figure 9:
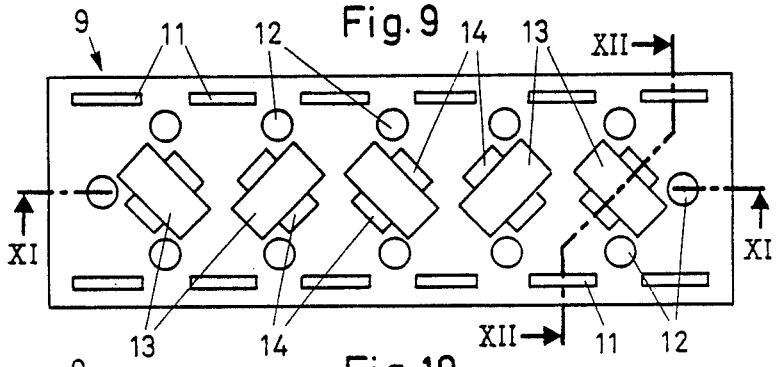
FIG. 9 is a top plan view of the lower support part depicted in FIG. 5.
Figure 12:
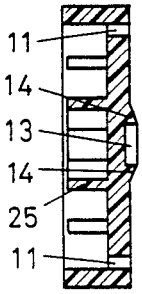
FIG. 12 is a cross sectional view taken along line XII—XII of FIG. 9.
Figure 10:
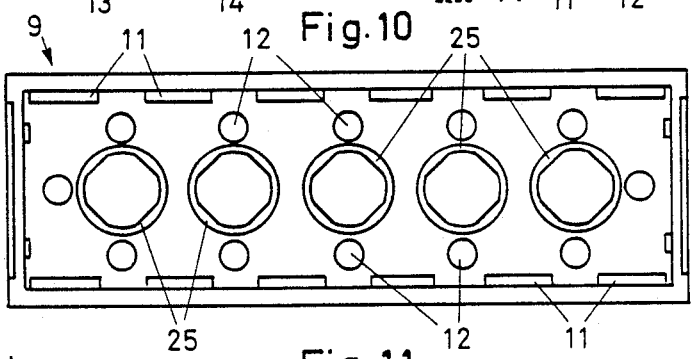
FIG. 10 is a view of the bottom side of the lower part depicted in FIG. 5.
Figure 11:
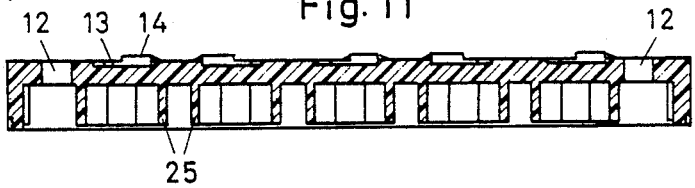
FIG. 11 is a longitudinal sectional view taken along line XI—XI in FIG. 9.

Details of the support part 9 can be seen in FIGS. 9 to 12. FIG. 9 illustrates the top of the support part 9. FIG. 10 depicts the underside of the top. Referring to FIG. 9 the slots 11 for prongs 19 of the metallic strips 15 and 16 can be seen as well as the holes 12 for the cover part pins 22 and the recesses 13. FIG. 10 also illustrates the slots 11 and the holes 12. In addition, FIG. 10 shows that the underside of support part 9 is provided with elongated sockets 25 which serve as mechanical counter-coupling members for the coupling pins 7, 8 when two similar blocks are plugged together. The sockets 25 as well as the recesses 13 and protrusions 14 are also shown, in section, in FIGS. 11 and 12.

Thus, FIGS. 6 and 9 show that the top of support part 9 as well as the underside of cover part 20 are provided with similar rectangular recesses 13 or 23, respectively, and pairs of protrusions 14 or 24, respectively in corresponding locations. It should be noted, however that the angular orientation of the recesses 13 and 23 are displaced by 90°. This will become apparent when it is realized that the underside of the cover part 20 (FIG. 6) is to be mounted on the top of support part 9 (FIG. 9).

For a further understanding of the building block of the present invention the assembly of the four components of the block will now be discussed. The components comprise: the support part 9 (FIG. 5); the metallic tapes 15 and 16 with coupling pins 7 and 8, respectively, (FIGS. 3 and 4); and the cover part 20.

In the first assembly step the prongs 19 of the metallic tape 16 (which contains coupling pins 8) are inserted into the slots 11 of the support part 9 and the tape 16 is pressed into position on the top of the support part 9. As a result the downwardly bent conductor segments 18 of the conductor tape 16 seat in the recesses 13 of the support part 9. The prongs 19 of the metallic tape 15 (which contains coupling pins 7) are then inserted into the remaining slots 11 of the support part 9 and the tape 15 is then pressed into position. Since the conductor segments of tape 15 are bent upwardly they will rest on the protrusions 14 and thus are physically as well as electrically spaced apart and separated from the conductor segments 18 of tape 16. In the final assembly step the cover part 20 (FIG. 2) is mounted over the partial assembly with the coupling pins 7, 8 passing through the holes 21 of the cover part and the pins 22 of the cover part being inserted into the holes 12 of the support part 9 which is facilitated by the conical shape of the ends of pins 22. The pins 22 are then ultrasonically or thermally anchored in position. Since ultrasound energy may be applied to the unit to aid in introducing the pins 22 into holes 12, this energy may also be used to weld the pins in position. Alternatively the pins 22 may first be introduced into the holes 12 and thereafter the exposed ends of the pins 22 which protrude through the top face of the support part 9 are heat welded.

As stated, when the cover part 20 is mounted on the support part 9 the upwardly bent conductor segments 17 of tape 15 are disposed in the recesses 23 of the cover part 20 while the conductor segments 18 of tape 16 are supported on the protrusions 24 of the cover part. Thus, each of the conductor segments 17, 18 is retained by corresponding protrusions 14 or 24 adjacent the recesses 23 or 13. This insures that a sufficient electrical separation will be maintained between the conductor segments without requiring the use of any additional insulating member.

It should be apparent that the relatively easy assembly of only four components as described above may readily be automated and practiced at high speed.

As can be seen from FIGS. 3 and 4 the prongs 19 of the metallic tapes 15 and 16 terminate in curved ends. When the building block is assembled, the curved ends engage the inner sides of the longitudinal sidewalls 3 of the support part 3. The prongs 19 are formed of a yielding metal and, as a result, when a block is plugged into another similar block an electrical contact is made between the coupling pins 7, 8 of the one block and the prongs 19 of the other block. In addition, by dimensioning the building block 1, including the coupling pins 7, 8 and the counter coupling sockets 25 to conform to those of a conventional building block (such as the previously mentioned LEGO® building block) the building block 1 can be mechanically coupled to a conventional block.

The building block 1 has two separate electrical circuits contained therein, one defined by the metallic strap 15 and the other by the metallic strap 16. If a number of building blocks 1 are coupled to one another the two circuits will always stay separated and short circuiting between the two is prevented as long as at least two conductive coupling pins of the one building block are coupled to two sockets of the other. This is true regardless of the complexity of the model formed with the blocks.

While the above invention has been described with coupling pins and sockets, it should be appreciated that other coupling members could also be used, such as pins and sockets having different geometric shapes such as for example, a square cross section.

Having thus described the invention what is claimed is:

1. A building block for a toy construction set comprising:

a top wall having an outer surface and an inner surface;

a side wall extending from said top wall;

a plurality of coupling pins on the outer surface of said top wall; said coupling pins each having electrically conductive means and said pins being arranged in at least two equally spaced rows forming at least two equally spaced columns of pins, the rows and columns being orthogonally directed:

means for electrically connecting alternate coupling pin conductive means of one row with alternate coupling pin conductive means of an adjacent row whereby no coupling pin is electrically connected to the coupling pin in neither the immediately adjacent row, nor the immediately adjacent column, thereby forming two separate electrical conductors; and, counter coupling means for engaging pins of another block, said counter coupling means being on said top wall inner surface and including said side wall.

2. The building block in accordance with claim 1 wherein said counter coupling means are arranged in at least one row and each said countercoupling means contains and is associated with a separate contact member electrically connected to one of said conductors; and alternate contact members of said row are electrically interconnected and electrically insulated from the other contact members of the same row.

3. The building block in accordance with claim 2 wherein said coupling pins (7,8) are formed as metallic hollow bodies.

4. The building block in accordance with claim 2 wherein said metallic hollow bodies are metallic hollow cylinders.

5. The building block in accordance with claim 2 wherein each of said contact members (19) comprises an elongated prong extending from said electrically conductive means of said coupling pin (7,8).

6. The building block in accordance with claim 2, wherein said conductive means of said coupling pins (7,8) and said associated contact members (19) of each conductor (15,16) are interconnected by strip segments (17,18) of conductive material, said conductive means of said coupling pins (7,8), said associated contact members (19) and said strip segments (17,18) of each conductor (15,16) being integrally formed from a strip of metallic material.

7. The building block in accordance with claim 6 wherein said associated contact members (19) are resiliently formed with respect to the conductive means of said coupling pins (7,8).

8. The building block in accordance with claim 6 wherein the strip segments (17 or 18) of one conductor are displaced upwardly and the strip segments of the other conductor are each displaced downwardly with respect to said outer surface.

9. The building block in accordance with claim 2, comprising a support part (9) having a top and a bottom face, said two separate conductors (15,16) and a cover plate (20) having a top and a bottom face, said electrically conductive means of said coupling pins (7,8) and said associated contact members (19) of each conductor (15,16) being interconnected by strip segments (17,18) of conductive material integrally formed therewith and said associated contact members (19) each comprising an elongated prong extending from said electrically conductive means of said coupling pin (7,8); said support part (9) including thereon two parallel rows of spaced slots (11); said cover plate (20) including two parallel rows of spaced openings (21); said conductor (15,16) prongs (19) passing through said slots (11) and said coupling pins conductive means (7,8) passing through said openings (21).

10. The building block in accordance with claim 9 wherein the strip segments of one conductor are each displaced upwardly and the strip segments of the other conductor are each displaced downwardly with respect to said outer surface and wherein one of the top face of the support part and bottom face of said cover plate is provided with recesses and the other of said faces is provided with protrusions positioned to space said upwardly and outwardly displaced strip segments of the conductors apart from each other.

11. The building block in accordance with claim 10 wherein one of the top face of said support plate (9) and bottom of said cover plate (20) is provided with pins (22) and the other of said face is provided with holes (12) aligned with said pins (22); said pins (21) being received and anchored within said holes (12).

* * * * *